United States Patent [19]

McMinn et al.

[11] 3,980,537

[45] Sept. 14, 1976

[54] PRODUCTION OF ALUMINUM-SILICON ALLOYS IN AN ELECTROLYTIC CELL

[75] Inventors: Curtis Jefferson McMinn, Florence; Alton Theodore Tabereaux, Jr., Sheffield, both of Ala.

[73] Assignee: Reynolds Metals Company, Richmond, Va.

[22] Filed: Oct. 3, 1975

[21] Appl. No.: 619,376

[52] U.S. Cl. ..... 204/71; 75/148

[51] Int. Cl.[2] ..... C25C 3/36; C22C 21/02

[58] Field of Search ..... 204/71, 64 R; 75/148

[56] References Cited

UNITED STATES PATENTS 1,835,244 12/1931 Schorn ..... 204/71

3,765,878 10/1973 Bullough ..... 75/148

*Primary Examiner*—John H. Mack

*Assistant Examiner*—Aaron Weisstuch

*Attorney, Agent, or Firm*—Glenn, Lyne, Gibbs & Clark

[57] ABSTRACT

A method of achieving improved operation of aluminum reduction cells being used to produce aluminum-silicon alloys, and related aspects of introducing silica and alumina to supply the requirements thereof to obtain an alloy of the desired silicon content.

20 Claims, No Drawings

PRODUCTION OF ALUMINUM-SILICON ALLOYS IN AN ELECTROLYTIC CELL

This invention concerns the production of aluminum-silicon alloys, including hypereutectic alloys containing in excess of 10 percent silicon by weight, and it relates particularly to improvements in the art of making Al-Si alloys in an aluminum reduction cell.

BACKGROUND OF THE INVENTION

Aluminum-silicon alloys have been made for a long time by simply adding crushed silicon metal or a high-silicon aluminum base master alloy to a body of molten aluminum. Thus, in one such approach, an electrolytic reduction cell is operated normally to produce aluminum and then solid silicon is added to the aluminum in the cell, or to the aluminum in a holding furnace after recovering it from the cell. Performing the alloying operation in a holding furnace has certain advantages because the melting of fairly large pieces of silicon at the temperature of molten aluminum in a reduction cell takes quite a while, and the heat required tends to upset the cell or interfere with its normal operating behavior.

It has also been proposed to make aluminum-silicon alloys by adding sand or another suitable source of silica to molten aluminum for reaction therewith to reduce the silica to silicon metal. Practicing this in aluminum reduction cells has been difficult for various reasons, although some success has been achieved by carefully controlling the silica additions and reducing the normal feeding of alumina into the molten salt bath of such cells to compensate for alumina generated by the reaction of aluminum with the added silica.

One of the remaining problems with which the present invention is concerned, however, is that the direct addition of sand to an aluminum reduction cell often results in the formation of such heavy ridges of deposited solids along the bottom of the cell, especially between the sidewalls of the cell and the anode, that the cell soon becomes inoperable, sometimes within a few days and often within a week or two.

These ridges are to be distinguished from those of an essentially cryolite-alumina composition encountered in ordinary reduction cell operations. The latter ridges are more readily avoided or more easily redissolved, usually by changing the anode-cathode spacing to increase the cell voltage and raise its bath temperature. The ridges presently referred to involve an accumulation of solid material separating from the liquid cryolite-alumina-silica system, that seems to build up from and upon the conventional formations. There have been occasions when this deposited material has been so excessive as to restrict downward movement of the anode, and operation of the cell could be continued only by running at increased voltage in an inefficient manner. These deposits have also caused anode-cathode short circuits which reduce production.

GENERAL DESCRIPTION OF THE INVENTION

It is an object of the present invention, therefore, to provide a procedure or practice for the planned and carefully controlled operation of an aluminum reduction cell to produce Al-Si alloys, using additions of silica directly to the cell, and effective for regulating the total distributive oxide concentration of its bath, so as to promote the stabilization of and limit the size and placement of ridge formations, and thereby sustain long-term efficient operation of the cell. This includes an intentional cycling of the temperature of the bath, based primarily on regulating the rates of feeding alumina and silica into the bath.

The term "aluminum-silicon alloy" as used herein refers to an aluminum base alloy in which silicon is the principal alloying element by weight. It will be readily apparent, however, that other intentional alloying additions may be made to alter the Al-Si composition as originally produced, either in the reduction cell itself or by adding such elements subsequently. The term "aluminum" as used herein refers to the substantially pure metal and various predominantly aluminum compositions extending from the highest purity aluminum attainable in an aluminum reduction cell to the lowest purity satisfactorily produced in such a cell consistent with obtaining the desired aluminum-silicon alloy. In general it is preferred, for purposes of the present invention, to employ an alumina ($Al_2O_3$) feed material of conventional purity, containing only negligible amounts of various metallic impurities, and to employ a source of high-purity silica such as crushed high-purity sandstone, silica sand, byproduct silica (such as amorphous silica recovered from arc furnaces), crushed glass, or quartzite, and normally containing in excess of 95 weight percent $SiO_2$.

In accordance with one aspect of the invention, we control the silica and alumina additions to the cell, and the relationship between them, to minimize the separation and build-up of undesired accretions. We believe that the development of some form of sodium aluminum silicate is the major cause of troublesome ledge formations previously described, and that such material will tend to separate from the electrolyte after the addition of even controlled increments of siliceous matter as previously known in the art. Whatever the particular compound or compounds concerned, this material is only slowly soluble in molten cryolite, so that adequate opportunity must be provided for its periodic dissolution in the bath in order to avoid excessive accumulations.

One convenient practice for this purpose may be expressed as follows in relation to the normal pattern of feeding alumina into the bath periodically ($n$ times over a 24-hour period), with each such feeding operation adding approximately $1/n$th of the total daily requirement of alumina, where the integer $n$ in the practice of the present invention is preferably from 4 to 15. For each feeding of silica, we add $(1/n-2)$th (if $n \leqslant 6$), and $1/(n-4)$th (if $6<n<15$), of the daily requirement of silica, thus providing fewer feedings of silica than of alumina. Stated more generally, we provide for the feeding of alumina to be divided into approximately equal incremental portions of the cell's alumina requirements, and these increments are introduced into the bath frequently at fairly uniform intervals over at least a major portion of a given period of operation, such as 24 hours, preferably at intervals of about 1 to 4 hours. The feeding of silica is similarly divided, but into fewer increments of approximately equal amounts, and these incremental feedings of alumina and silica are coordinated such that on some occasions of feeding alumina into the bath the feeding of silica is deferred, and at other times both alumina and silica are added to the bath.

We prefer to spread out each charge of silica with the loose alumina on the crust. This spreading is recommended because silica-rich, solid crust becomes soft prematurely and falls into the bath, exposing the liquid surface and causing unnecessary heat losses and volatilization of the bath. The practice also helps to preheat and dry the silica before it enters the bath. Also, the silica is preferably added in increments no greater than about two weight percent (2%) of the weight of molten bath in any two-hour period, which, for a typical cell having a bath content of about 8500 lbs. (+500 lbs./ − 800 lbs.) imposes an upper limit of about 170 lbs. of silica for each such addition.

In a further aspect of the method of operation discussed above, particularly for purposes of controlling the formation of ledges, we prefer to withhold the feeding of alumina and silica entirely at the final two (or up to four) regularly scheduled crust breaking operations during each daily cycle of operation. The temperature of the molten cell contents will rise about 5°–15°C as the oxides are depleted after the feeding and crust breaking operations are omitted. This increase in temperature, along with the lower oxide content, promotes the dissolution of the separating material associated with silica being added to the bath. If the total oxide content is depleted sufficiently for an anode effect to occur, i.e., in the range 0.5 to 2 percent dependent upon current density and cell conditions, the cell will undergo further heating and stirring which results in more re-solution of ledge material. Under some conditions, the lowering of the oxide content and consequent heating may be sufficient to control the ledging condition while avoiding the disruption of operation and extra voltage of the anode effect. Under more severe conditions of ledging, such as might be caused by extra heavy additions of silica, it is advantageous to continue the oxide depletion until an anode effect occurs. While the interruption of the crust breaking and feeding schedule, and the subsequent increase in cell temperature, causes a small loss in production, the advantages concerning the control and stabilization of the ridge geometry, and limitation of the amount of difficultly soluble, silica-containing muck or sludge under the metal pad, have been found to outweigh the disadvantages.

After an anode effect, and prior to resuming the next scheduled feeding of both alumina and silica, as previously described, we prefer to operate briefly on a feeding of alumina only. This may be continued, for example, until the point of tapping the cell to remove accumulated aluminum-silicon alloy if that is to be done reasonably soon. Such tapping operations are usually scheduled on a 24-hour or 48-hour cycle.

In the period of operation following a suspension of silica additions, it has been observed that the bath $Al_2O_3/SiO_2$ ratio increases to the range of 5 to 15, from as low as about 2 to 4 during regular feeding of both alumina and silica, showing a closer approach to thermodynamic equilibrium conditions. This aspect of the operation in accordance with the invention allows sufficient time for the reaction.

$$4\ Al + 3\ SiO_2 \rightarrow 3\ Si + 2\ Al_2O_3$$

to occur and for the similar reaction between ledge-generating cumulative solid matter and the liquid alumina-rich phase suspended or entrapped in the metal cathode pad of the cell.

At higher anodic current densities (> 6 amp/in$^2$), the normal voltage across a cell producing more than 6 weight percent silicon alloy may require a slightly higher setting, e.g., 40 to 100 millivolts higher than a cell reducing metallurgical aluminum only, because we have found conditions when the electrical conductivity of the bath is depressed (presence of $SiO_2$ in the bath decreases the electrical conductivity). If the cell voltage were not increased slightly, the interelectrode distance would be kept at too short a distance with adverse effects in the immediate current efficiency and long-term mass balance and distribution of alumina and silica-rich phases.

When the anodic current densities are lower ( ≤ 5 amp in$^{-2}$), cell voltages for cells producing alloys from sand in the range of 0.5 to about 20 weight percent silicon need not be distinguishably different from those of cells producing pure aluminum or those producing comparable alloys through the insertion of lump silicon metal into the cell. These voltage settings are in fact dictating the heat balance for the cell.

We have also found it helpful in avoiding or minimizing the development of silicate-containing ridges to control the depth of the metal pad (cathode reservoir). No precise depth can be assigned this parameter because it differs for different cell designs at given line currents. We have noted, however, that it is better to maintain a given minimum level of molten metal in the cell than to allow the depth to increase. Heat transfer through the cathode increases with an excess of greater than one inch of metal depth to the extent that the propensity for separation of solid phase is increased and "ridges" accumulate, necessitating subsequent undesired corrective action.

We have also found that when silica is added to a cell at the same time alumina is added we volatilize only very minor amounts of silicon or silicon compounds from the system. Material balances from industrial scale cells producing silicon-aluminum alloy, with the silica being added concurrently with alumina, typically show a conversion of at least about 97 percent of silicon. When siliceous materials are added to cells when the alumina content of the bath is very low, or when these additions are not made in combination with alumina additions, a higher loss of silicon occurs due possibly to formation and volatilization of certain compounds such as $SiF_4$.

The use of high-grade siliceous material is essential. If, for instance, excess calcium or sodium compounds are put into the electrolyte through the use of lower grade sand or quartz, then the composition of the electrolyte is sufficiently disturbed to disadvantageously affect the conductivity of the bath and promote initial separation of a sodium-aluminum-silicate phase, which only gradually dissolves into the cryolitic bath. Also, the $NaF/AlF_3$ ratio can vary considerably in such circumstances, and excess soda or calcium can lead to solidification of salts less soluble in cryolite than a suspected less troublesome phase, e.g., $NaAlSi_3O_8$.

EXAMPLE 1

Producing 17% silicon alloy in a 75KA cell.

The first step in operating the cell to produce an Al-Si alloy was adding silicon metal to adjust the cell's metal pad composition to the desired 17 percent silicon content. After this, with the added silicon fully dissolved and the cell stabilized, the feeding of sand was started.

For the first five days of operation two additions of 100 lbs. of sand per addition were made each day and one addition of 200 lbs. of silicon metal. Following this transition period the feeding of sand was increased to 400 lbs. per day and silicon metal additions were terminated.

As operation of the cell continued, the sand additions were made 100 lbs. at a time, on alternate sides of the cell, for four consecutive breaks or feedings at four-hour intervals. For the next eight hours after the last of these four feedings that included sand additions, alumina and silica additions were skipped until the cell had an anode effect. This cycle was repeated every 24 hours.

The cell was tapped periodically (24-hour or 48-hour intervals) to remove the Al-Si alloy.

Thus, a typical 24-hour sequence of events was conducted as summarized in Table I.

EXAMPLE 2

Producing 17% silicon alloy in a 90 KA cell.

After adjusting the cell's metal pad composition to 17% silicon content and following a transition period similar to that described in Example 1, a 24 hour cycle of operation was established that provided for ledge and oxide control without an anode effect during each cycle. When cell conditions indicated a need for more ledge control or dissolution than was being accomplished by this technique, this 24 hour cycle was modified to include an anode effect. This modification to the cycle was made to the benefit of the operation once every 5 – 10 days.

A typical 24-hour sequence of events was conducted as summarized in Table II.

TABLE I

PRODUCING 17% SILICON ALLOY - SODERBERG REDUCTION CELL - (24-Hour Cycle of Operation)

| Time | Operation | Comments | Typical Conditions Volts (V) | Temperature (°C) | $Al_2O_3/SiO_2$ Ratio | $NaF/AlF_3$ Ratio |
|---|---|---|---|---|---|---|
| 0600 | Break in alumina only | Continuing opportunity to reduce $SiO_2$ content of bath and ridges. Melting out ridges. | 4.7 | 948 | 5 | 1.43 |
| 0730 | Spread 100 lb of high-grade sand on the crust with loose alumina, on both sides and close to the anode | Supplying one-half of daily silicon requirements for drying, preheating and mixing with alumina. Next to anode, so as to fall to metal-bath interface rather than to sidewall ledges. | 4.75 | 950 | 13 | 1.45 |
| 0830 | Tap and lower anode | Remove 2 days' production (~2,480 lb). Just prior, total oxide very low. | 4.72 | 948→940 →946 | 13→6 →2.5 | 1.39 |
| 1000 | Break crust at front side of pot to feed alumina & silica | Replenish oxides. Supply $SiO_2$ for reaction to Si. Approx. 200 lb of aluminum silicate removed from solution in ½ hr. | | | | |
| 1400 | Break crust at back side of pot to feed alumina & silica | Replenish oxides. Some dissolution of silicate separated in previous break. | 4.80 | 950 | 2→4 | 1.43 |
| 1500 | Spread 100 lb of sand along both sides of the anode | | | | | |
| 1800 | Break front side | Replenish oxides, dissolved and lying on ledges and bottom. | 4.75 | 945 | 2→4 | 1.44 |
| 2200 | Break back side | Ditto. Clean up of undesirable solids. | | | | |
| 0200 | Scheduled break; not performed | Necessary oxides supplied from continuing dissolution of alumina silicates. | 4.80 | 952 | 5→10 | 1.45 |
| 0517 | Anode effect | Establishes "end point" to dissolution of alumina silicates. | 20 | 965 | 10→15 | 1.44 |
| 0600 | Break in alumina only | | | | | |

TABLE II

PRODUCING 17% SILICON ALLOY - SODERBERG REDUCTION CELL AT 90 KA (24-Hour Cycle of Operation)

| Time | Operation | Comments | Typical Conditions Volts (V) | Temp. (°C) | $Al_2O_3/SiO_2$ Ratio | $NaF/AlF_3$ Ratio |
|---|---|---|---|---|---|---|
| 0600 | Break in alumina only | Continuing opportunity to reduce $SiO_2$ content of bath and ridges. Melting out ridges. | 4.82 | 952 | 8 | 1.44 |
| 0800 | Spread 125 lb of high-grade sand on the crust with loose alumina, on both sides and close to the anode | Supplying one-half of daily silicon requirements for drying, preheating and mixing with alumina. Next to and length of anode, so as to fall to metal-bath interface rather than to sidewall ledges. | 4.85 | 954 | 13 | 1.44 |
| 0900 | Tap and lower anode | Remove one day's production (~1100 lb). | 4.85 | 955 | 13 | 1.45 |
| 1000 | Break crust at front side of pot to feed alumina and silica | Replenish oxides. Supply $SiO_2$ for reaction to Si. Approx. 200 lb of aluminum silicate removed from solution in ½ hr. | 4.80 | 946 | 2–4 | 1.38 |
| 1400 | Break crust at back side of | Replenish oxides. Some dissolution of | 4.78 | 944 | 2–4 | 1.40 |

TABLE II-continued

PRODUCING 17% SILICON ALLOY - SODERBERG REDUCTION CELL AT 90 KA
(24-Hour Cycle of Operation)

| Time | Operation | Comments | Typical Conditions Volts (V) | Temp. (°C) | $Al_2O_3/SiO_2$ Ratio | $NaF/AlF_3$ Ratio |
|---|---|---|---|---|---|---|
| | pot to feed alumina and silica. | silicates separated in previous break. | | | | |
| 1500 | Spread 125 lb of sand along both sides of anode | | | | | |
| 1800 | Break front side | Replenish oxides, dissolved and lying on ledges and bottom. | 4.76 | 942 | 2–4 | 1.39 |
| 2200 | Break back side | Ditto. Clean up of undesirable solids. | 4.77 | 944 | 2–4 | 1.40 |
| 0200 | Scheduled break; not performed | Necessary oxides supplied from continuing dissolution of alumina silicates. | 4.80 | 945 | 5–10 | 1.41 |
| 0600 | Break in alumina only | Replenish oxides. Just prior, total oxide very low | 4.83 | 950 | 10–18 | 1.44 |

What is claimed is:

1. The method of operating an aluminum reduction cell to produce an aluminum-silicon alloy, including the steps of feeding alumina and silica into a molten salt bath of the cell and passing electric current through the bath, wherein:

a. said feeding of alumina comprises introducing approximately equal incremental amounts of alumina effective in the aggregrate to supply the cell's alumina requirements, b. said feeding of silica comprises introducing approximately equal incremental amounts of silica effective in the aggregate to supply the cell's corresponding requirements of silica to produce an alloy of the desired silicon content, and c. these incremental feeding operations are conducted on a coordinated basis such that at times substantially only alumina is added to the bath and the feeding of silica is deferred, while at other times both alumina and silica are added to the bath.

2. The method of claim 1 wherein, preparatory to feeding both alumina and silica, an incremental amount of silica is spread out with loose alumina on the crust of said cell, and, to accomplish such feeding, an underlying portion of said crust is broken into the bath.

3. The method of claim 1, including the start-up step of adjusting the silicon content of the cell's metal pad to the desired alloy composition, and thereafter supplying silica in amounts effective to provide all of the silicon metal required for continuing operation of the cell to produce said alloy.

4. The method of claim 1, including tapping the cell to remove an accumulation of aluminum-silicon alloy at least once during each 48-hour period of operation.

5. The method of claim 4 wherein said incremental feeding operations include introducing both alumina and silica into the bath repeatedly over a major portion of the time interval between successive tapping operations.

6. The method of claim 5, including discontinuing said feeding of alumina and silica at least once during the interval between successive tapping operations and continuing to operate the cell without feeding long enough to effect control of ridges.

7. The method of claim 6 wherein said feeding is discontinued long enough to cause an anode effect.

8. The method of claim 7 wherein the cell is tapped about 2 to 4 hours following an anode effect.

9. The method of claim 7, including initially feeding substantially only alumina following said anode effect.

10. The method of claim 6, including tapping the cell daily to remove aluminum-silicon alloy and resuming said feeding of both alumina and silica following said tapping operation.

11. The method of claim 10 wherein said feeding after a tapping operation comprises a daily cycle of repeatedly introducing both alumina and silica at intervals of about 1 to 4 hours, omitting at least the last two scheduled feedings of said cycle and continuing to operate the cell without feeding long enough to effect control of ridges.

12. The method of claim 11 wherein, for feeding alumina into the bath in 4 to 6 increments daily, about 2 fewer increments of feeding silica are used.

13. The method of claim 11 wherein, for feeding alumina into the bath in more than 6 increments daily, up to 4 fewer increments of feeding silica are used.

14. The method of operating an aluminum reduction cell to produce an aluminum-silicon alloy, including the steps of feeding alumina and silica into the molten salt bath of said cell and passing electric current through the bath, which method comprises:

introducing incremental amounts of alumina into the bath $n$ times during each 24-hour period of operation, wherein $n$ is an integer from 4 to 15, with each such amount representing about $1/n$th of the cell's daily requirement of alumina; and introducing incremental amounts of silica effective in the aggregate to supply the cell's corresponding daily requirements of silica to produce an alloy of the desired silicon content, with each such amount not exceeding about 2 percent of the weight of the molten bath, the number of said incremental feedings of silica being no more than $n$-2, for $n \leq 6$; and being only about $n$-4, for $6<n<15$.

15. The method of claim 14 wherein said $n$ feedings of alumina occur at substantially uniform intervals of about 1 to 4 hours.

16. The method of claim 14 wherein each of said incremental feedings of silica is combined with one of said incremental feedings of alumina.

17. The method of claim 14 wherein the cell is operated periodically without feeding long enough to cause an anode effect, and initially operated with a feeding of substantially only alumina after each anode effect.

18. The method of operating an aluminum reduction cell to produce a hypereutectic aluminum-silicon alloy, including the steps of feeding alumina and silica into a molten salt bath of the cell and passing electric current through the bath, comprising:

repeatedly feeding into the bath of said cell both alumina and silica at substantially uniform intervals in the range of about 1 to 4 hours over at least a major portion of each daily period of operation, each such feeding being effect to introduce about $1/n$th of the cell's daily requirement of alumina and a larger fraction up to about one-half of the cell's daily requirement of silica to obtain an alloy of the deisred silicon content, discontinuing said feedings of alumina and silica at least once daily and continuing to operate the cell without feeding long enough to reduce the total bath oxide content to a level effective to control ridge formations, there being for each feeding cycle prior to said continuing operation without feeding a total of $n$ feedings to supply alumina, where $n$ is an integer from 4 to 15, of which no more than $(n\text{-}2)$ include a feeding of silica, for $n \leqslant 6$, and of which only about $(n\text{-}4)$ include a feeding of silica, for $6<\lambda$ $n<15$.

19. The method of operating an aluminum reduction cell to produce an aluminum-silicon alloy, including the steps of feeding alumina and silica into a molten salt bath of said cell and passing electric current through the bath, wherein said feeding comprises:

spreading out a measured charge of silica with loose alumina on the crust of said cell, so as to minimize the development of high-silica crust formations;

breaking an underlying portion of the crust to introduce the silica and a related quantity of alumina into the bath; and periodically omitting to deposit a charge of silica and breaking in a portion of the crust to feed substantially only alumina into the bath.

20. The method of claim 19, including periodically omitting to feed both alumina and silica while continuing to operate the cell, therby causing its total bath oxide content to become depleted, and, after continued operation without feeding, initially feeding substantially only alumina into the bath.

* * * * *